US012760918B2

(12) United States Patent
Nguyen et al.

(10) Patent No.: US 12,760,918 B2
(45) Date of Patent: Oct. 13, 2026

(54) AIR CONDITIONER HOUSING CONTAINING REFRIGERANT SENSOR

(71) Applicant: Mitsubishi Electric US, Inc., Cypress, CA (US)

(72) Inventors: Donald Nguyen, Cypress, CA (US); William Sanders, Cypress, CA (US)

(73) Assignee: Mitsubishi Electric US, Inc., Cypress, CA (US)

( * ) Notice: Subject to any disclaimer, the term of this patent is extended or adjusted under 35 U.S.C. 154(b) by 323 days.

(21) Appl. No.: 18/733,332

(22) Filed: Jun. 4, 2024

(65) Prior Publication Data

US 2025/0369637 A1 Dec. 4, 2025

(51) Int. Cl.

*F24F 11/36* (2018.01)
*F24F 13/20* (2006.01)
*F24F 110/65* (2018.01)

(52) U.S. Cl.

CPC ..... *F24F 11/36* (2018.01); *F24F 13/20* (2013.01); *F24F 2110/65* (2018.01)

(58) Field of Classification Search

CPC ..... F24F 11/36; F24F 13/20
See application file for complete search history.

(56) References Cited

U.S. PATENT DOCUMENTS

| | | | | |
|---|---|---|---|---|
| 10,753,631 | B2 * | 8/2020 | Ikawa | F25B 41/00 |
| 11,326,797 | B2 * | 5/2022 | Shaffer | F24F 11/89 |
| 11,441,813 | B2 | 9/2022 | Tsuji et al. | |
| 2013/0095744 | A1 | 4/2013 | McKie et al. | |
| 2020/0393140 | A1 * | 12/2020 | Nouchi | F25B 49/02 |
| 2021/0041114 | A1 * | 2/2021 | Watanabe | F24F 1/0063 |
| 2023/0400217 | A1 | 12/2023 | Alphonso | |
| 2025/0237405 | A1 * | 7/2025 | Gotakhindi | F24F 11/89 |

FOREIGN PATENT DOCUMENTS

| | | | | |
|---|---|---|---|---|
| CN | 203797358 | U | 8/2014 | |
| CN | 204288446 | U | 4/2015 | |
| CN | 209639905 | U | 11/2019 | |
| CN | 211234587 | U | 8/2020 | |
| CN | 211668591 | U | 10/2020 | |
| CN | 216873598 | U | 7/2022 | |
| EP | 3730854 | A1 * | 10/2020 | F24F 11/36 |
| JP | 6448981 | B2 | 1/2019 | |
| WO | WO-2020059006 | A1 * | 3/2020 | F25B 49/02 |
| WO | 2023/135845 | A1 | 7/2023 | |

* cited by examiner

*Primary Examiner* — Stephanie E Bloss
*Assistant Examiner* — Diana Hancock
(74) *Attorney, Agent, or Firm* — Posz Law Group, PLC

(57) ABSTRACT

A housing is provided for an air conditioner circuit, comprising: an access panel configured to partially cover the air conditioner circuit and including a panel surface formed on an outside of the housing, a panel opening in the panel surface passing from the outside of the housing toward an inside of the housing; a refrigerant sensor configured to detect a presence of a refrigerant in air proximate to the refrigerant sensor; and a sensor cover attached to an outside of the housing and configured to cover the panel opening and the refrigerant sensor, wherein the refrigerant sensor is located at least partly inside the panel opening.

20 Claims, 11 Drawing Sheets

AIR CONDITIONER HOUSING CONTAINING REFRIGERANT SENSOR

TECHNICAL FIELD

The disclosed systems and methods relate generally to an air conditioner including a sensor circuit for detecting refrigerant in the air-conditioner. Specifically, the sensor circuit is located within a wall of the air conditioner's housing or an access panel that allows access to the air conditioner through the air conditioner's housing. The sensor circuit can be located in full or in part within the wall or access panel in a hole in the insulation of the housing or access panel or attached to an outside of the wall or access panel.

BACKGROUND

An air conditioner will generally include a heat exchanger, which may include coils through which a refrigerant flows, e.g., an A-coil. One common type of refrigerant used by such air conditioners is an A2L refrigerant, e.g., R454B or R32. The designation A2L indicates that the refrigerant is non-toxic (A), is flammable (2), and has a low burning velocity (L). Other refrigerants may also be used, with varying parameters. Other possible refrigerants include A1, B2, B1, A2, which may be either flammable, toxic, or both. In addition, refrigerants such as propane or butane are sometimes used.

In the air conditioner, the refrigerant is cooled in a cooling operation and heated in a heating operation, and air is passed over the coils. This causes the air to exchange heat with the refrigerant passing through the coils and be either heated or cooled depending upon the type or operation being performed.

During heating and cooling operations, a coil-based heat exchanger can leak refrigerant into the air surrounding the heat exchanger. This often happens where pipes are brazed, though other types of leaks are also possible.

Leaks in a heat exchanger coil are undesirable for several possible reasons. First, if the refrigerant used in air conditioners is toxic, leaked refrigerant may cause a health hazard to people in the building containing the air conditioner. Leaked refrigerant from the air conditioner can be blown into the area being heated or cooled and may be breathed by those inside that the building containing the air-conditioner. Second, if the refrigerant is flammable, leaked refrigerant can increase the fire risk in the building containing the air-conditioner. Third, since the proper operation of a coil-based heat exchanger requires sufficient refrigerant pass through the coils, a leakage of refrigerant can cause the air conditioner to function less efficiently. Fourth, leaked refrigerant must be replaced, meaning that a refrigerant leak will result in additional costs for operating the air conditioner.

As a result, many air conditioners contain one or more refrigerant sensors to detect refrigerant leaks so that they can be identified and corrected quickly, and so avoid or minimize the problems identified above.

However, it is also desirable to make air conditioners as small as possible to minimize the amount of space they take up in a building. It is therefore desirable to provide a refrigerant sensor that takes up as little space as possible.

Furthermore, given the need to make air conditioners as small as possible, space inside an air conditioner housing is often at a premium. It is therefore desirable to provide a refrigerant sensor that takes up as little space as possible within an air conditioner housing.

SUMMARY OF THE INVENTION

According to one or more embodiments, A housing for an air conditioner circuit, comprising: an access panel configured to partially cover the air conditioner circuit and including a panel surface formed on an outside of the housing, a panel opening in the panel surface passing from the outside of the housing toward an inside of the housing; a refrigerant sensor configured to detect a presence of a refrigerant in air proximate to the refrigerant sensor; and a sensor cover attached to an outside of the housing and configured to cover the panel opening and the refrigerant sensor, wherein the refrigerant sensor is located at least partly inside the panel opening.

The access panel may further include panel insulation attached to the panel surface and located between the panel surface and the air conditioner circuit, the access panel may further include an insulation opening in the panel insulation passing from the outside of the housing toward the inside of the housing and formed contiguous with the panel opening, and the refrigerant sensor may be located at least partly inside the insulation opening.

The refrigerant sensor may be deeper than a panel depth of the panel surface and an insulation depth of the panel insulation combined.

The refrigerant sensor may extend out of the panel insulation in a direction of the air conditioner circuitry. The refrigerant sensor may extend out of the panel surface in a direction of the sensor cover.

The sensor cover may include: a sensor cover surface; and sensor insulation formed between the sensor cover surface and the panel opening.

The sensor cover may include a sensor cover surface made of a first metal, and the panel surface may be made of a second metal. The sensor cover may include a sensor cover surface made of plastic, and the panel surface may be made of metal.

The sensor cover may be formed in the shape of a truncated pyramid.

The refrigerant sensor may further comprise: a sensor circuit configured to detect a presence of the refrigerant in air proximate to the sensor circuit; and a sensor casing surrounding the sensor circuit.

The access panel may be located on a side of the air conditioner circuit facing where pipes in a heat exchanger in the air conditioner circuit have been brazed.

The housing may further comprise: a mounting bracket attached to the panel surface and extending into or adjacent to the panel opening, wherein the refrigerant sensor is affixed to the mounting bracket.

A housing is provided for an air conditioner circuit, comprising: a housing surface formed on an outside of the housing; a housing opening in the housing surface passing from the outside of the housing toward an inside of the housing; a refrigerant sensor configured to detect a presence of a refrigerant in air proximate to the refrigerant sensor; and a sensor cover affixed to an outside of the housing and configured to cover the housing opening and the refrigerant sensor, wherein the refrigerant sensor is located at least partly inside the housing opening.

The housing may further include housing insulation attached to the housing surface and located between the housing surface and the air conditioner circuit, the housing may further include an insulation opening in the housing insulation passing from the outside of the housing toward the inside of the housing and formed contiguous with the housing opening, and the refrigerant sensor may be located at least partly inside the insulation opening.

The refrigerant sensor may be deeper than a housing depth of the housing surface and an insulation depth of the housing insulation combined.

The refrigerant sensor may extend out of the housing insulation in a direction of the air conditioner circuitry. The refrigerant sensor may extend out of the housing surface in a direction of the sensor cover.

The sensor cover may include: a sensor cover surface; and sensor insulation formed between the sensor cover surface and the housing opening.

The sensor cover may include a sensor cover surface made of a first metal, and the housing surface may be made of a second metal. The sensor cover may include a sensor cover surface made of plastic, and the housing surface may be made of metal.

The refrigerant sensor may further comprise: a sensor circuit configured to detect a presence of the refrigerant in air proximate to the sensor circuit; and a sensor casing surrounding the sensor circuit.

The housing opening may be located on a side of the air conditioner circuit facing where pipes in a heat exchanger in the air conditioner circuit have been brazed.

The housing may further comprise: a mounting bracket attached to the housing surface and extending into or adjacent to the housing opening, wherein the refrigerant sensor is affixed to the mounting bracket.

A housing is provided for an air conditioner circuit, comprising: an access panel configured to partially cover the air conditioner circuit and including a panel surface formed on an outside of the housing, a panel hole in the panel surface passing from the outside of the housing toward an inside of the housing; a refrigerant sensor configured to detect a presence of a refrigerant in air proximate to the refrigerant sensor; and a sensor cover affixed to an outside of the housing and configured to cover the panel hole and the refrigerant sensor, wherein the refrigerant sensor is located at least partly between the sensor cover and the access panel.

The refrigerant sensor may be located entirely between the sensor cover and the access panel.

The housing may further comprise one or more connection wires connected between the refrigerant sensor and the air conditioner circuitry, wherein the one or more connection wires pass through the panel hole.

The sensor cover may include a sensor cover surface made of a first metal, and the panel surface may be made of a second metal. The sensor cover may include a sensor cover surface made of plastic, and the panel surface may be made of metal.

The sensor cover may include: a sensor cover surface; and sensor insulation formed between the sensor cover surface and the access panel, and the refrigerant sensor may be located at least partly between the sensor insulation and the access panel.

The refrigerant sensor may be located entirely between the sensor insulation and the access panel.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Sensor with Casing Inside Access Panel

Figure 1:
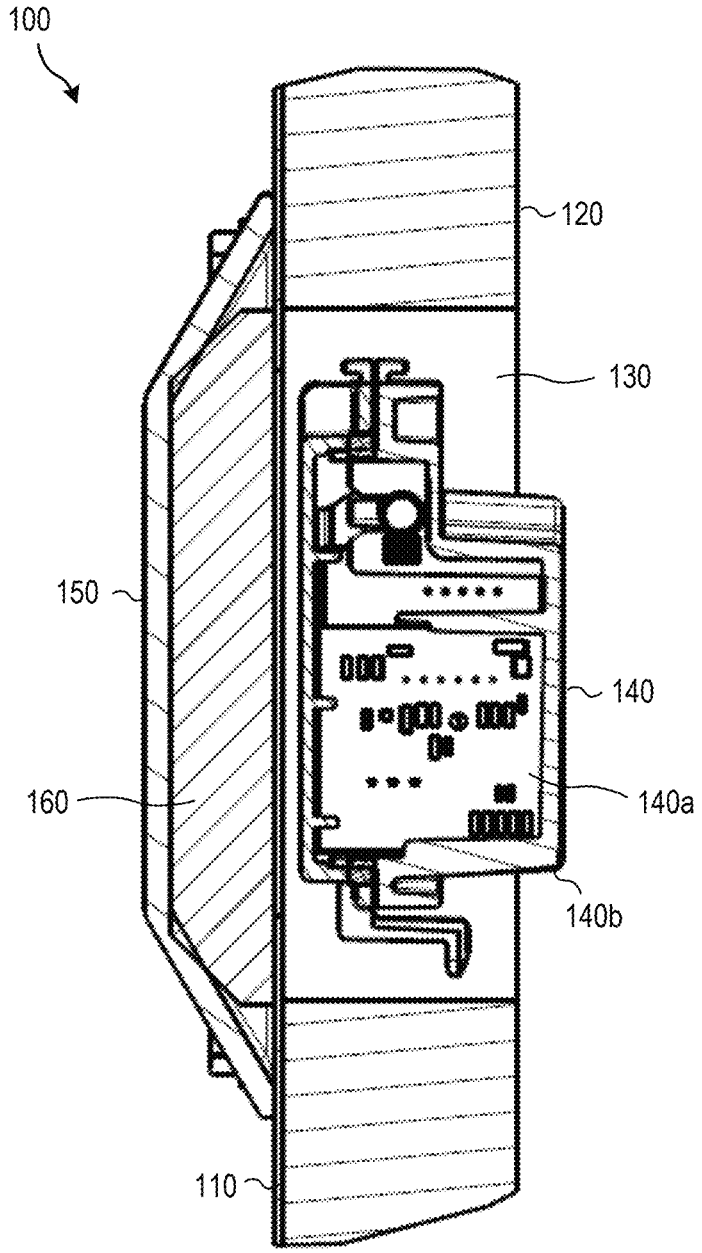
FIG. 1 is a side view of a refrigerant sensor inside an access panel according to disclosed embodiments.

FIG. 1 is a side view of a refrigerant sensor 140 inside an access panel 110 according to disclosed embodiments. As shown FIG. 1, the disclosed arrangement includes an access panel 110, panel insulation 120, an opening 130 in the access panel 110, the refrigerant sensor 140, a sensor cover 150, and cover insulation 160. The refrigerant sensor 140 includes a refrigerant sensor circuit 140*a* that is surrounded by a protective casing 140*b*.

The access panel 110 is a panel that covers an opening in an air-conditioner housing (not shown and sometimes referred to as simply "the housing") that is used to access air conditioning circuitry (not shown) within the housing. The access panel 110 can be of various shapes or materials. For example, it can be made from metal or plastic or any other suitable material. The access panel 110 will generally be of a size and shape sufficient to allow maintenance of the air conditioning circuitry within the housing through the opening in the housing covered by the access panel 110. The access panel 110 may have a variety of openings in it to accommodate pipes, wires, etc. These openings can include the opening 130 used to contain the refrigerant sensor 140. The access panel 110 will have a detachable way of connecting to the housing, e.g., screws, bolts, clamps, clips, magnets, or the like.

The panel insulation 120 is provided on the interior of the access panel 110 and between the access panel 110 and the air conditioning circuitry inside the housing. The insulation is used to insulate the hot or cold pipes within the air-conditioner and prevent heat from passing between the interior of the air conditioner and the exterior of the air conditioner. This keeps the operation of the air conditioner more efficient. The panel insulation 120 on the interior of the access panel 110 may be comparable to similar insulation on the interior of the remainder of the housing. However, this is by way of example only. In some alternate embodiments a different type of panel insulation 120 can be used on the interior of the access panel 110 as is used in the remainder of the housing.

In various embodiments, the panel insulation 120 can the fiberglass, mineral wool, foam glass, expanded polystyrene (EPS), extruded polystyrene (XPS), cellulose, spray foam, fiberboard, calcium silicate, phenolic foam, glass wool, polyurethane, rock wool, EPDM, neoprene, or any other suitable form of insulation.

The opening 130 in the access panel 110 is provided at a position on the access panel 110 close to where a refrigerant leak might occur. For example, the opening 130 could be placed proximate to where pipes in a heat exchanger are brazed. These are points at which refrigerant leaks are most likely.

The opening 130 passes through the access panel 110 and the panel insulation 120 such that it provides a passage from outside of the access panel 110 to the interior of the housing when the access panel 110 is secured to the housing. The opening 130 may be of a size comparable to that of the refrigerant sensor 140 such that it accommodates the refrigerant sensor 140 with a minimum clearance around the refrigerant sensor 140. Specifically, in some embodiments the opening 130 and the refrigerant sensor 140 will be approximately the same size; and in other embodiments the opening 130 may be larger than the refrigerant sensor 140.

The refrigerant sensor 140 is a circuit configured to detect the presence of refrigerant in air proximate to the refrigerant sensor 140. It can be configured to identify a quantifiable level of refrigerant in the nearby air, or it can be configured to identify when the level of refrigerant in the nearby air rises above the threshold refrigerant level in various embodiments. In some embodiments the refrigerant sensor 140 will be configured to detect a minimum threshold of refrigerant that will activate safety features and a response such as sounding an alarm or turning on a fan to circulate and dilute leaked refrigerant in the air in or proximate to the air conditioner. In an embodiment in which the refrigerant is an A2L refrigerant, the refrigerant sensor 140 is an A2L refrigerant sensor.

The refrigerant sensor 140 will also have some sort of communication capability with the air conditioner controller (e.g., a wired connection or a wireless connection) to allow it to communicate the refrigerant level to the air conditioner controller. Although this is not shown explicitly in FIGS. 1-4, its details should be easily understood.

In the embodiment of FIGS. 1-4, the depth of the refrigerant sensor 140 is greater than the depth of the opening 130 such that a portion of the refrigerant sensor 140 extends outside of the opening 130 in the direction of the interior of the housing. However, this is by way of example only. In alternate embodiments, the refrigerant sensor 140 could extend out of the opening 130 in the opposite direction towards the exterior of housing, or a depth of the refrigerant sensor 140 could be equal to or less than a depth of the opening 130 allowing the refrigerant sensor to fit entirely within the opening 130.

The refrigerant sensor circuit 140*a* includes the actual circuitry used to detect the presence of the refrigerant in air proximate to the refrigerant sensor 140. The protective casing 140*b* surrounds the refrigerant sensor circuit 140*a* and serves to protect it from damage or contamination. In various embodiments the protective casing 140*b* can be plastic, metal, ultraviolet resistant polymers, protective polymers, or any suitable protective material.

The sensor cover 150 is a structure configured to fully overlap the opening 130 such that it can fully obscure the opening 130 when it is secured to the access panel 110. The sensor cover 150 may include structure to allow it to be secured to the access panel 110, e.g., screw holes, bolt holes, flanges to accommodate clamps, magnetic clamps, etc.

The sensor cover 150 can have a sensor cover surface made of the same material as the access panel 110, or it may be made of a different material from the access panel 110. For example, if the access panel 110 is made of metal, the sensor cover 150 could be made of either metal or plastic or any other suitable material. If the sensor cover 150 and the access panel 110 are both made of metal, they can be made of the same metal for different metals as appropriate.

The cover insulation 160 is provided between the sensor cover 150 and the opening 130. It serves to insulate the opening 130, which does not contain any of the panel insulation 120 present on the rest of the access panel 110. In addition, in embodiments in which the sensor cover 150 and the access panel 110 are both made of metal, the cover insulation 160 can prevent the sensor cover 150 and the access panel 110 from having substantially different temperatures, which may cause condensation to form either on the sensor cover 150 or at a point where the sensor cover 150 meets the access panel 110.

In embodiments in which there is either no danger of condensation or small danger of condensation, the cover insulation 160 can be omitted.

In the embodiment of FIG. 1, the cover insulation 160 substantially fills the space between the sensor cover 150 and the opening 130. However, this is by way of example only. In alternate embodiments, the refrigerant sensor 140 may extend through the opening 130 partially past the level of the access panel 110 and into a space between the access panel 110 and the sensor cover 150. In this case, the dimensions of the cover insulation 160 may be altered to allow for the protruding portion of the refrigerant sensor 140 to extend into the space between the access panel 110 the sensor cover 150. In alternate embodiments the cover insulation may only partially fill the opening between the sensor cover 150 and the access panel 110 for other reasons.

In various embodiments, the cover insulation 160 can the fiberglass, mineral wool, foam glass, expanded polystyrene (EPS), extruded polystyrene (XPS), cellulose, spray foam, fiberboard, calcium silicate, phenolic foam, glass wool, polyurethane, rock wool, EPDM, neoprene, or any other suitable form of insulation. The cover insulation 160 may be the same as the panel insulation 120 in some embodiments and may be different from the panel insulation 120 in other embodiments.

Figure 2:
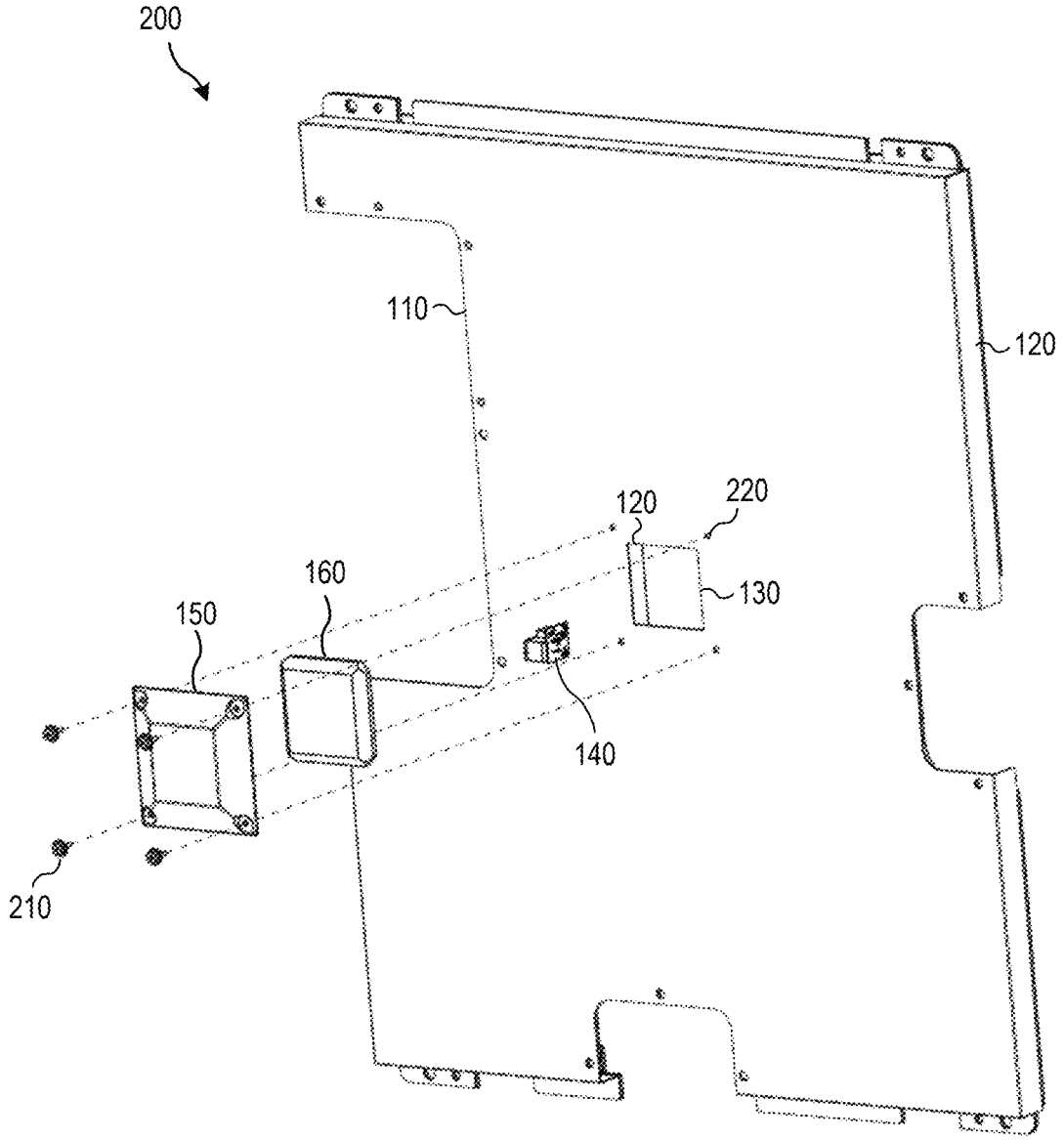
FIG. 2 is an expanded perspective view of the refrigerant sensor and access panel of FIG. 1 according to disclosed embodiments.

FIG. 2 is an expanded perspective view of the sensor and access panel of FIG. 1 according to disclosed embodiments.

As shown in FIG. 2, the sensor cover 150 is secured to the access panel 110 through the use of screws 210 that affix the sensor cover 150 to screw holes 220 in the access panel 110. In this way, the sensor cover 150 is secured to the access panel 110 in a manner such that the sensor cover 150 completely obscures the opening 130.

Although screws 210 are used to affix the sensor cover 150 to the access panel 110 in the embodiment of FIGS. 1-4, this is by way of example only. Alternate embodiments could use a different means of securing the sensor cover 150 to the access panel 110. For example, alternate embodiments could employ bolts, clamps, clips, magnets, adhesive, or any other desirable means of affixing the sensor cover 150 to the access panel 110

The cover insulation 160 is placed between the sensor cover 150 and the opening 130 such that the cover insulation 160 provides heat insulation between the opening 130 and exterior of the sensor cover 150.

The refrigerant sensor 140 is placed in the opening 130 such that it is completely obscured by the sensor cover 150 and the cover insulation 160.

As shown in FIG. 2, when the sensor cover 150 is removed, and the cover insulation 160 along with it, the refrigerant sensor 140 can be exposed without the need for removing the entire access panel 110. In this way, an operator or maintenance technician can access the refrigerant sensor 140 more easily and without having to remove the entire access panel 110. This can allow for easier monitoring, maintenance, repair, or replacement of the refrigerant sensor 140 as necessary.

Figure 3:
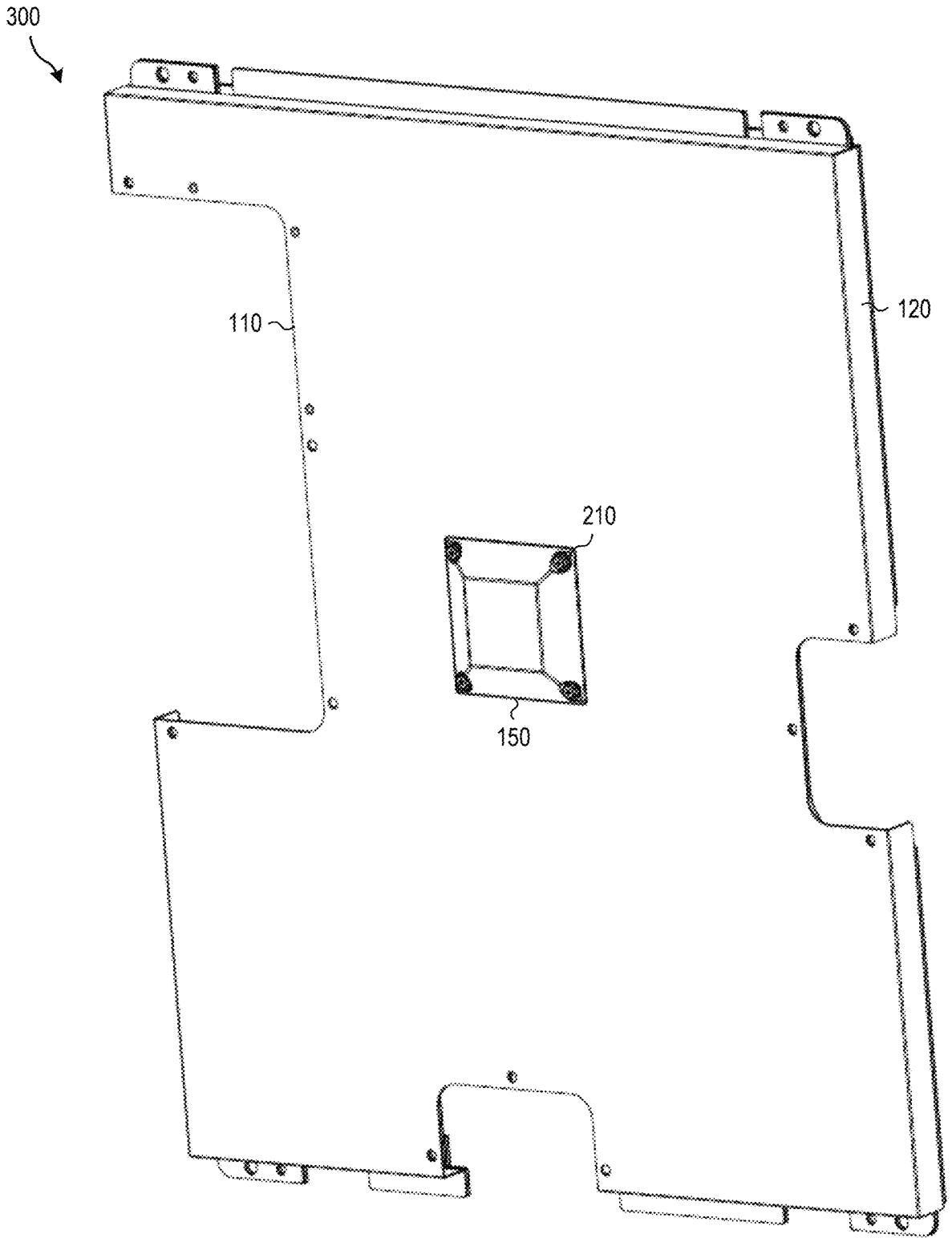
FIG. 3 is a perspective view of the refrigerant sensor and access panel of FIG. 1 in a secured position according to disclosed embodiments.

FIG. 3 is a perspective view of the sensor cover 150 and access panel 110 of FIG. 1 in a secured position according to disclosed embodiments.

As shown in FIG. 3, once the sensor cover 150 is secured to the access panel 110, the cover insulation 160, the opening 130, and the refrigerant sensor 140 are completely obscured by the sensor cover 150. In this way, the refrigerant sensor 140 is protected by the sensor cover 150.

Figure 4:
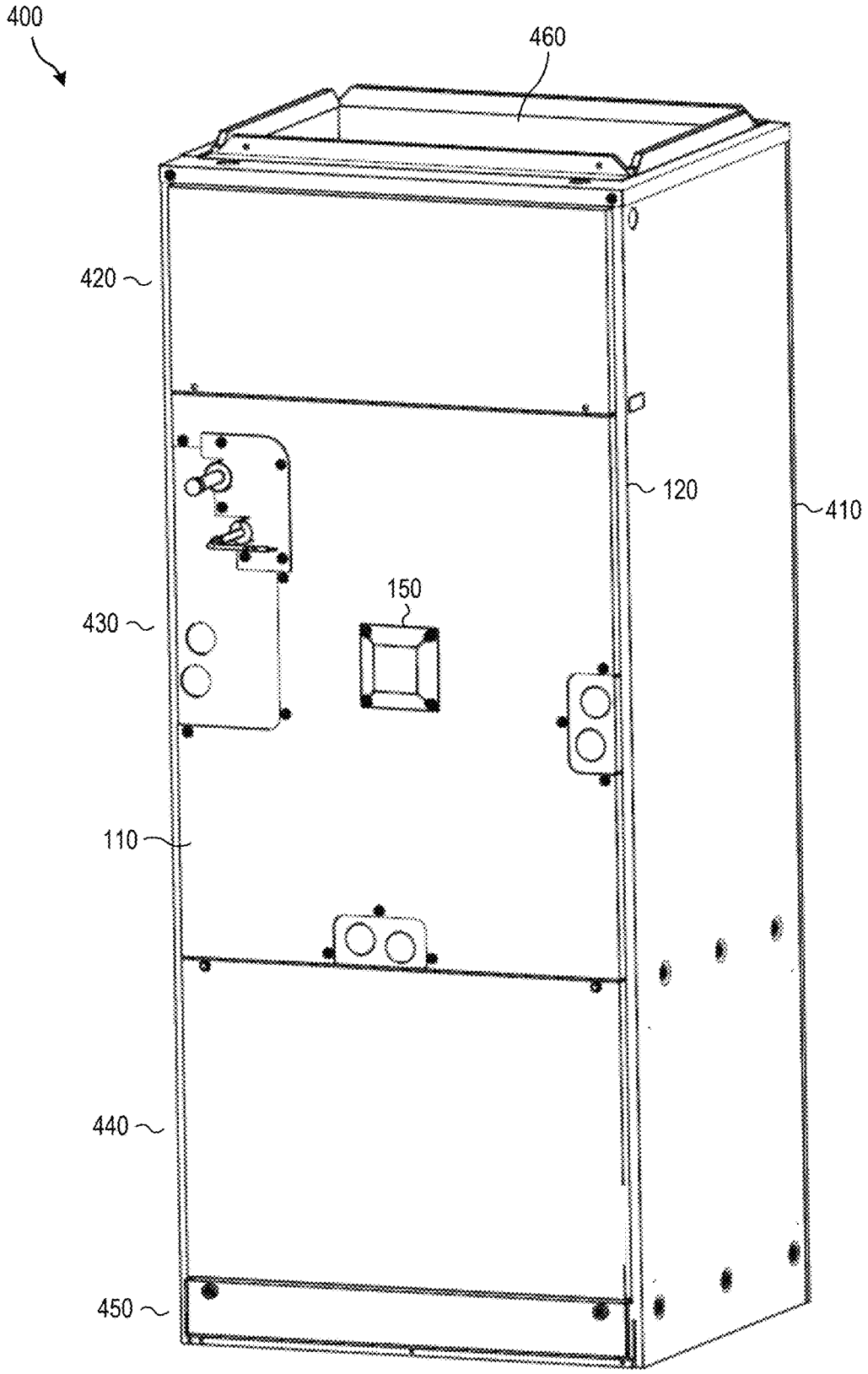
FIG. 4 is a perspective view of an air conditioner containing the refrigerant sensor and the access panel of FIG. 1 according to disclosed embodiments.

FIG. 4 is a perspective view of an air conditioner 400 containing the refrigerant sensor 140 and access panel 110 of FIG. 1 according to disclosed embodiments.

As shown in FIG. 4, the air conditioner 400 includes an air-conditioner housing 410 that surrounds a number of elements that make up the air conditioner 400. These elements include an electrical section 420, a heat exchanger section 430, a blower section 440, and a filter section 450. In addition, a blow-out vent 460 is provided on the top of the air-conditioner housing 410.

The air-conditioner housing 410 (sometimes called simply the "housing") can be made of metal, plastic, or any suitable material that can protect the various elements that make up the air conditioner 400. The air-conditioner housing 410 substantially surrounds the elements that make up the air conditioner 400 with the exception of an opening (not shown) covered by the access panel 110, the blow-out vent 460, and an input vent (not shown) used to draw air into the air conditioner 400. The housing 410 may also have various other holes or openings to allow pipes, wires, and the like to pass between the interior of the housing 410 and the exterior of the housing 410.

The material that makes up the air-conditioner housing 410 can be metal, plastic, or any desirable material. This material may be the same material that makes up the access panel 110 in some embodiments, or it may be a different material than the material that makes up the access panel 110 in alternate embodiments.

The electrical section 420 includes some or all of the control electronics (not shown) required to operate the air conditioner 400.

The heat exchanger section 430 includes a heat exchanger (not shown) used to circulate refrigerant that exchanges heat with air passing through the air conditioner 400.

The blower section 440 includes a fan (not shown) used to draw air into the air conditioner 400, pass the air over the heat exchanger to exchange heat with the refrigerant, and expel the air from the blow-out vent 460.

The filter section 450 includes a filter (not shown) used to filter contaminants or other particulate matter out of the air passing through the air conditioner 400.

The blow-out vent 460 is an opening in the air-conditioner housing 410 that allows conditioned air to be expelled to an area outside of the air conditioner 400.

In the embodiment of FIG. 4, the electrical section 420, the heat exchanger section 430, the blower section 440, and the filter section 450 are stacked in that order from top to bottom. However, this is by way of example only. In alternate embodiments, the electrical section 420, the heat exchanger section 430, the blower section 440, and the filter section 450 can be rearranged in any desirable arrangement. For example, the heat exchanger section 430 could be in the middle of the air conditioner 400, on the top of the air conditioner 400, or on the bottom of the air conditioner 400, as desired.

The access panel 110 is arranged adjacent to the heat exchanger section 430 such that the heat exchanger section can be exposed when the access panel 110 is removed. This allows for easier monitoring or maintenance of the heat exchanger, or repair or replacement of elements within the heat exchanger.

Furthermore, since the heat exchanger section 430 is the section of the air conditioner 400 most likely to suffer a refrigerant leak, the arrangement of the access panel 110 adjacent to the heat exchanger section 430 allows for the opening 130, the refrigerant sensor 140, and the sensor cover 150 to be arranged proximate to the heat exchanger for more efficient detection of a refrigerant leak.

This is particularly important given that some regulations require that refrigerant leaks be detected within a set minimum amount of time. By placing the refrigerant sensor 140 proximate to the heat exchanger, the refrigerant sensor 140 can be arranged in a position in which it is capable of sensing and a refrigerant leak within the prescribed time.

Sensor without Casing Inside Access Panel

Figure 5:
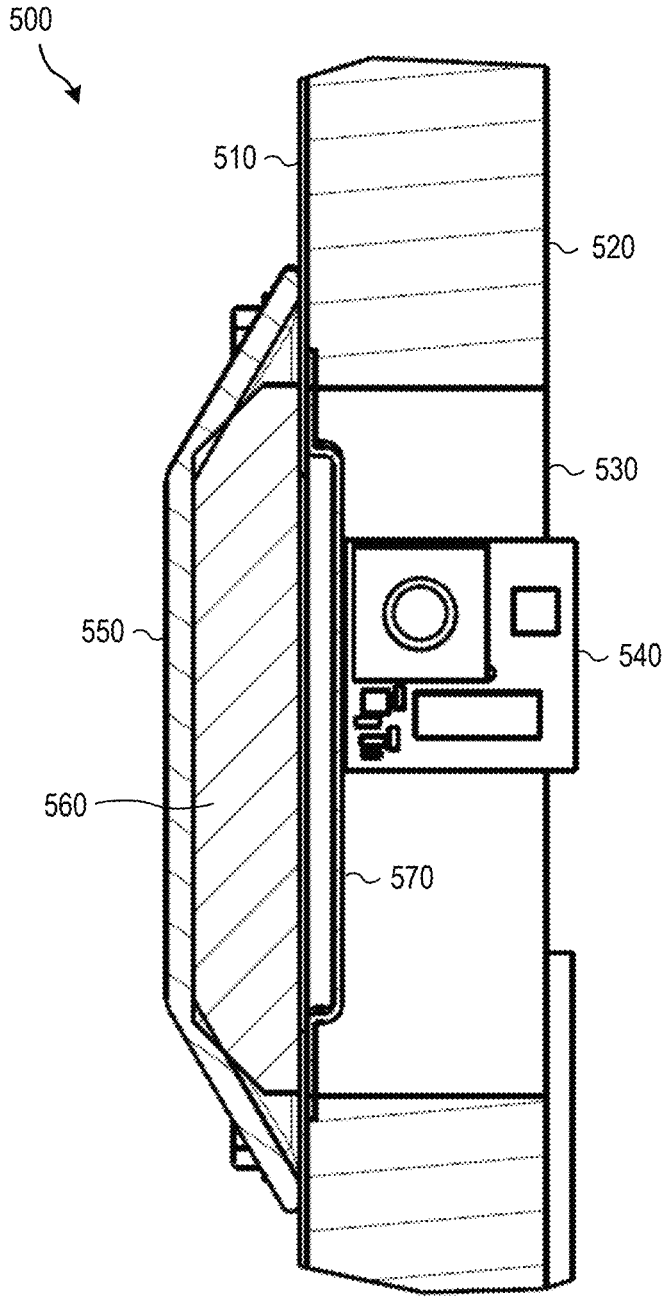
FIG. 5 is a side view of a refrigerant sensor inside an access panel according to alternate disclosed embodiments.

FIG. 5 is a side view of a sensor inside an access panel according to alternate disclosed embodiments. As shown FIG. 1, the disclosed arrangement includes an access panel 510, panel insulation 520, an opening 530 in the access panel 510, a refrigerant sensor 540, a sensor cover 550, and cover insulation 560.

The access panel 510 is a panel that covers opening in an air-conditioner housing that is used to access air conditioning circuitry within the housing and is comparable to the access panel 110 in FIG. 1. The access panel 510 can be of various shapes or materials. For example, it can be made from metal or plastic or any other suitable material. It will generally be of size and shape sufficient to allow maintenance of the air conditioning circuitry within the housing through the opening in the housing covered by the access panel 510. The access panel 510 may have a variety of openings in it to accommodate pipes, wires, etc. These openings can include the opening 530 used to contain the refrigerant sensor 540.

The panel insulation 520 is comparable to the panel insulation 120 in FIG. 1 and is provided on the interior of the access panel 510 and between the access panel 510 and the air conditioning circuitry inside the housing. The panel insulation 520 is used to insulate the hot or cold pipes within the air-conditioner to keep the operation of the air conditioner more efficient. The panel insulation 520 on the interior of the access panel 510 may be the same as the insulation on the interior of the remainder of the housing. However, this is by way of example only. In some alternate embodiments a different type of panel insulation 520 can be used on the interior of the access panel 510 is used in the remainder of the housing.

In various embodiments, the panel insulation 520 can the fiberglass, mineral wool, foam glass, expanded polystyrene (EPS), extruded polystyrene (XPS), cellulose, spray foam, fiberboard, calcium silicate, phenolic foam, glass wool, polyurethane, rock wool, EPDM, neoprene, or any other suitable form of insulation.

The opening 530 in the access panel 510 is provided at a position on the access panel 510 close to where a refrigerant leak might occur. For example, the opening 530 could be placed proximate to where pipes in a heat exchanger are brazed. These are points at which refrigerant leaks are most likely.

The opening 530 passes through the access panel 510 and the panel insulation 520 such that it provides a passage from outside of access panel 510 to the interior of the housing when the access panel 510 is secured to the housing. The opening 530 may be of a size comparable to that of the refrigerant sensor 540 such that it accommodates the refrigerant sensor 540 with a minimum clearance around the refrigerant sensor 540. In some embodiments the opening 530 will be approximately the same size as the refrigerant sensor 540; in other embodiments the opening 530 may be larger than the refrigerant sensor 540

The refrigerant sensor 540 is a circuit configured to detect the presence of refrigerant in air. It can be configured to identify a quantifiable level of refrigerant in the nearby air, or it can be configured to identify when the level of refrigerant in the nearby air rises above the threshold refrigerant level in various embodiments. In some embodiments the refrigerant sensor 540 will be configured to detect a minimum threshold of refrigerant that will activate safety features and a response such as sounding an alarm or turning on a fan to circulate and dilute leaked refrigerant in the air in or proximate to the air conditioner. In an embodiment in which the refrigerant is an A2L refrigerant, the refrigerant sensor 540 is an A2L refrigerant sensor.

The refrigerant sensor 540 will also have some sort of communication capability with the air conditioner controller (e.g., a wired connection or a wireless connection) to allow it to communicate the refrigerant level to the air conditioner controller. Although this is not shown explicitly in FIG. 5, its details should be easily understood.

In the embodiment of FIG. 5, the depth of the refrigerant sensor 540 is greater than the depth of the opening 530 such that a portion of the refrigerant sensor 540 extends outside of the opening 530 in the direction of the interior of the housing. However, this is by way of example only. In alternate embodiments, the refrigerant sensor 540 could extend out of the opening 530 in the opposite direction towards the exterior of housing, or a depth of the refrigerant sensor 540 could be equal to or less than a depth of the opening 530 allowing the refrigerant sensor 540 to be contained entirely within the opening 530.

In the embodiment of FIG. 5, the refrigerant sensor 540 is made up of a refrigerant sensor circuit that includes the actual circuitry used to detect the presence of the refrigerant in air proximate to the refrigerant sensor 540. The refrigerant sensor 540 in this embodiment does not have a protective casing that surrounds the refrigerant sensor circuit.

The sensor cover 550 is comparable to the sensor cover 150 in FIGS. 1-4 and is a structure configured to fully overlap the opening 530 such that it can fully obscure the opening 530 when it is secured to the access panel 510. The sensor cover 550 may include structure to allow it to be secured to the access panel 510, e.g., screw holes, bolt holes, flanges, to accommodate clamps, snap-fit join assemblies, adhesive, etc.

The sensor cover 550 can have a sensor cover surface made of the same material as the access panel 510, or it may be made of a different material from the access panel 510. For example, if the access panel 510 is made of metal, the sensor cover 550 could be made of either metal or plastic or any other suitable material. If the sensor cover 550 can be access panel 510 are both made of metal, they can be made of the same metal for different metals as appropriate.

The cover insulation 560 is comparable to the cover insulation 160 in FIGS. 1-4 and is provided between the sensor cover 550 and the opening 530. It serves to insulate the opening 530, which does not contain any of the panel insulation 520 present on the rest of the access panel 510. In addition, in embodiments in which the sensor cover 550 and the access panel 510 are both made of metal, the cover insulation 560 can prevent the sensor cover 550 and the access panel 510 from having substantially different temperatures, which may cause condensation to form either on the sensor cover 550 or at a point where the sensor cover 550 meets the access panel 510.

In the embodiment of FIG. 5, the cover insulation 560 substantially fills the space between the sensor cover 550 and the opening 530. However, this is by way of example only. In alternate embodiments, the refrigerant sensor 540 may extend through the opening 530 partially past the level of the access panel 510 and into a space between the access panel 510 and the sensor cover 550. In this case, the dimensions of the cover insulation 560 may be altered to allow for the protruding portion of the refrigerant sensor 540 to extend into the space between the access panel 510 the sensor cover 550. In other alternate embodiments the cover insulation may not fully fill the space between the sensor cover 550 and the access panel 110 for other reasons.

In various embodiments, the cover insulation 560 can the fiberglass, mineral wool, foam glass, expanded polystyrene (EPS), extruded polystyrene (XPS), cellulose, spray foam, fiberboard, calcium silicate, phenolic foam, glass wool, polyurethane, rock wool, EPDM, neoprene, or any other suitable form of insulation. The cover insulation 560 may be the same as the panel insulation 520 in some embodiments and may be different from the panel insulation 520 other embodiments.

Although not shown in FIG. 5, sensor cover 550 can be secured to access panel 510 in a manner similar to how the sensor cover 150 is secured to the access panel 110.

Sensor with Casing Inside Casing Cover

Figure 6:
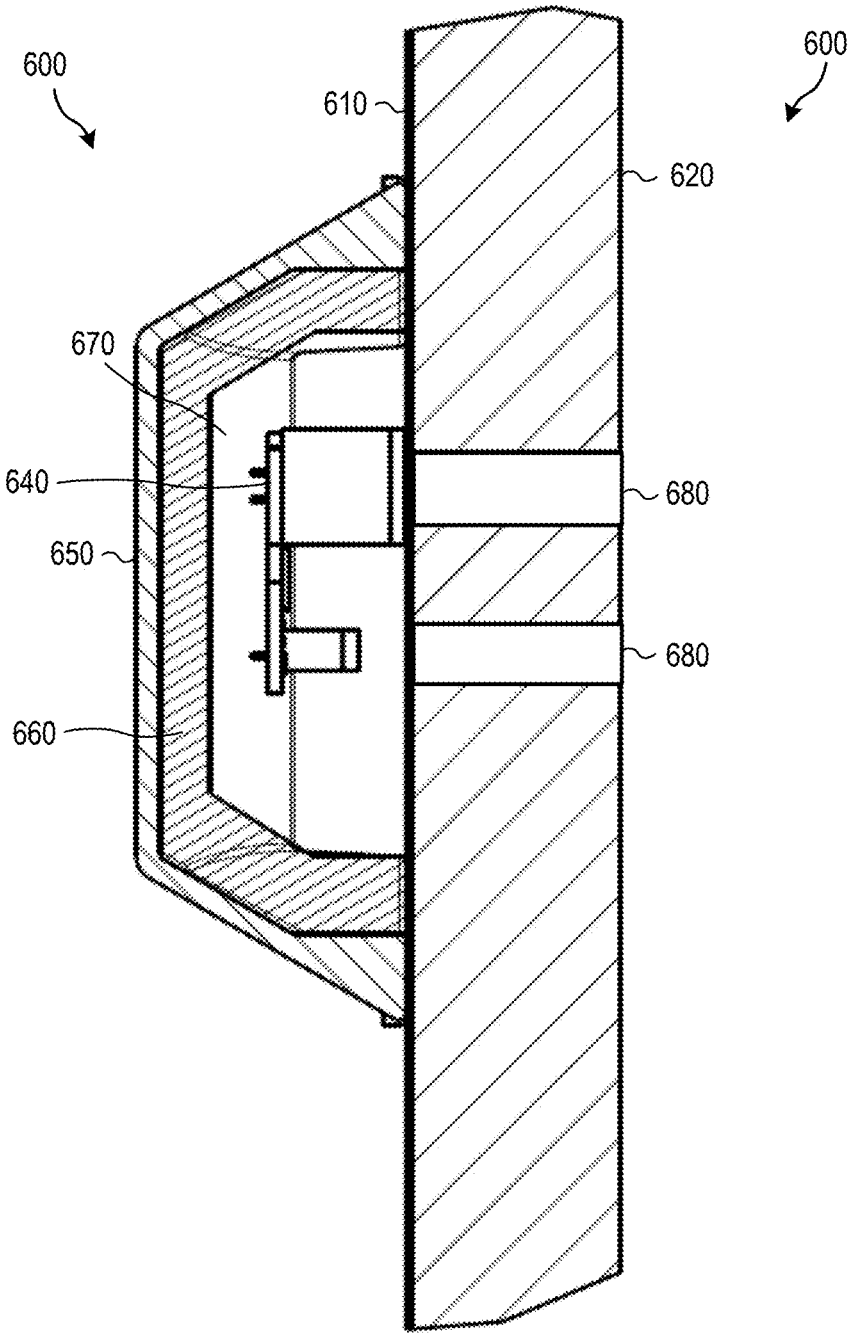
FIG. 6 is a side view of a refrigerant sensor inside a sensor cover attached to an access panel according to disclosed embodiments.

FIG. 6 is a side view of a refrigerant sensor 640 inside a sensor cover 650 attached to an access panel 610 according to disclosed embodiments. As shown FIG. 6, the disclosed arrangement includes the access panel 610, panel insulation 620, the refrigerant sensor 640, the sensor cover 650, and cover insulation 660. The sensor cover 650 and the cover insulation 660 are arranged to form an opening 670 in a concave portion of this structure for the refrigerant sensor 640 to rest. The access panel 610 and the panel insulation 620 further include one or more holes 660 passing through access panel 610 and the panel insulation 620 from an outside of an air-conditioner housing (not shown and sometimes referred to as simply "the housing") to an inside of the housing.

The access panel 610 is comparable to the access panel 110 in FIG. 1 and is a panel that covers an opening in the housing that is used to access air conditioning circuitry within the housing. The access panel 610 can be of various shapes or materials. For example, it can be made from metal or plastic or any other suitable material. It will generally be of size and shape sufficient to allow maintenance of the air-conditioning circuitry within the housing through the opening in the housing covered by the access panel 610. The access panel 610 may have a variety of openings in it to accommodate pipes, wires, etc. These openings can include the one or more holes 680.

The panel insulation 620 is provided on the interior of the access panel 610 and between the access panel 610 and the air-conditioning circuitry inside the housing. The panel insulation 620 is used to insulate the hot or cold pipes within the air conditioner to keep the operation of the air conditioner more efficient. The panel insulation 620 on the interior of the access panel 610 may be comparable to similar insulation on the interior of the remainder of the housing. However, this is by way of example only. In some alternate embodiments a different type of panel insulation 620 can be used on the interior of the access panel 610 is used in the remainder of the housing.

In various embodiments, the panel insulation 620 can the fiberglass, mineral wool, foam glass, expanded polystyrene (EPS), extruded polystyrene (XPS), cellulose, spray foam, fiberboard, calcium silicate, phenolic foam, glass wool, polyurethane, rock wool, EPDM, neoprene, or any other suitable form of insulation.

The refrigerant sensor 640 is a circuit configured to detect the presence of refrigerant in air. It can be configured to identify a level of refrigerant in the nearby air, or it can be configured to identify when the level of refrigerant in the nearby air rises above the threshold refrigerant level in various embodiments. In an embodiment in which the refrigerant is an A2L refrigerant, the refrigerant sensor 640 is an A2L refrigerant sensor.

The refrigerant sensor 640 will also have some sort of communication capability with the air conditioner controller (e.g., a wired connection or a wireless connection) to allow it to communicate the refrigerant level to the air conditioner controller. Although this is not shown explicitly in FIGS. 6-9, its details should be easily understood.

The refrigerant sensor 640 in this embodiment is located entirely between the access panel 610 and the sensor cover 650. In this way, refrigerant sensor 640 does not extend into access panel 610 panel insulation 620.

Although in the embodiment of FIGS. 6-9, the depth of the refrigerant sensor 640 is sufficiently small that it fits between access panel 610 and sensor cover 650, this is by way of example only. In alternate embodiments, refrigerant sensor 640 could partially extend into the access panel 610 and/or the panel insulation 620. In such embodiments, the access panel 610 and/or the panel insulation 620 would include an opening to accommodate the protrusion from the refrigerant sensor 640. This opening might extend all the way into the housing or might not extend all the way into the housing.

In various embodiments, the refrigerant sensor 640 could include only a refrigerant sensor circuit used to detect the presence of the refrigerant in air proximate to the refrigerant sensor 640 or it could also include a protective casing that surrounds a refrigerant sensor circuit and serves to protect it from damage or contamination.

The sensor cover 650 is a structure configured to fully overlap the one or more holes 680 and to accommodate the refrigerant sensor 640. The sensor cover 650 may include structure to allow it to be secured to the access panel 610, e.g., screw holes, bolt holes, flanges to accommodate clamps, magnets, adhesives, etc.

The sensor cover 650 can have a sensor cover surface made of the same material as the access panel 610, or it may be made of a different material from the access panel 610. For example, if the access panel 610 is made of metal, the sensor cover 650 could be made of either metal or plastic or any other suitable material. If the sensor cover 650 can be access panel 110 are both made of metal, they can be made of the same metal for different metals as appropriate.

The cover insulation 660 is provided between the sensor cover 650 and the refrigerant sensor 640. It serves to insulate the refrigerant sensor 640 and the air conditioner in general. In addition, in embodiments in which the sensor cover 650 and the access panel 610 are both made of metal, the cover insulation 660 can prevent the sensor cover 650 and the access panel 610 from having substantially different temperatures, which may cause condensation to form either on the sensor cover 650 or at a point where the sensor cover 650 meets the access panel 610.

In embodiments in which there is either no danger of condensation or small danger of condensation, the cover insulation 660 can be omitted.

In the embodiment of FIG. 6, the cover insulation 660 is provided such that it allows sufficient space between the cover insulation 660 and the access panel 610 for the refrigerant sensor 640 to rest.

In various embodiments, the cover insulation 660 can the fiberglass, mineral wool, foam glass, expanded polystyrene (EPS), extruded polystyrene (XPS), cellulose, spray foam, fiberboard, calcium silicate, phenolic foam, glass wool, polyurethane, rock wool, EPDM, neoprene, or any other suitable form of insulation. The cover insulation 660 may be the same as the panel insulation 620 in some embodiments and may be different from the panel insulation 620 other embodiments.

The opening 670 is formed in concave portion of the combination of the sensor cover 650 and the cover insulation 660. The opening is defined by an interior of the cover insulation 660. The opening 670 is of sufficient size to accommodate the refrigerant sensor 640.

The one or more holes 680 are provided in the access panel 610 and the panel insulation 620. They allow for pipes or cables to be connected between the refrigerant sensor 640 and control circuitry within the air-conditioner. FIG. 6 discloses the use of two holes 680. However, this is by way of example only. Alternate embodiments could include more or fewer holes 680.

Figure 7:
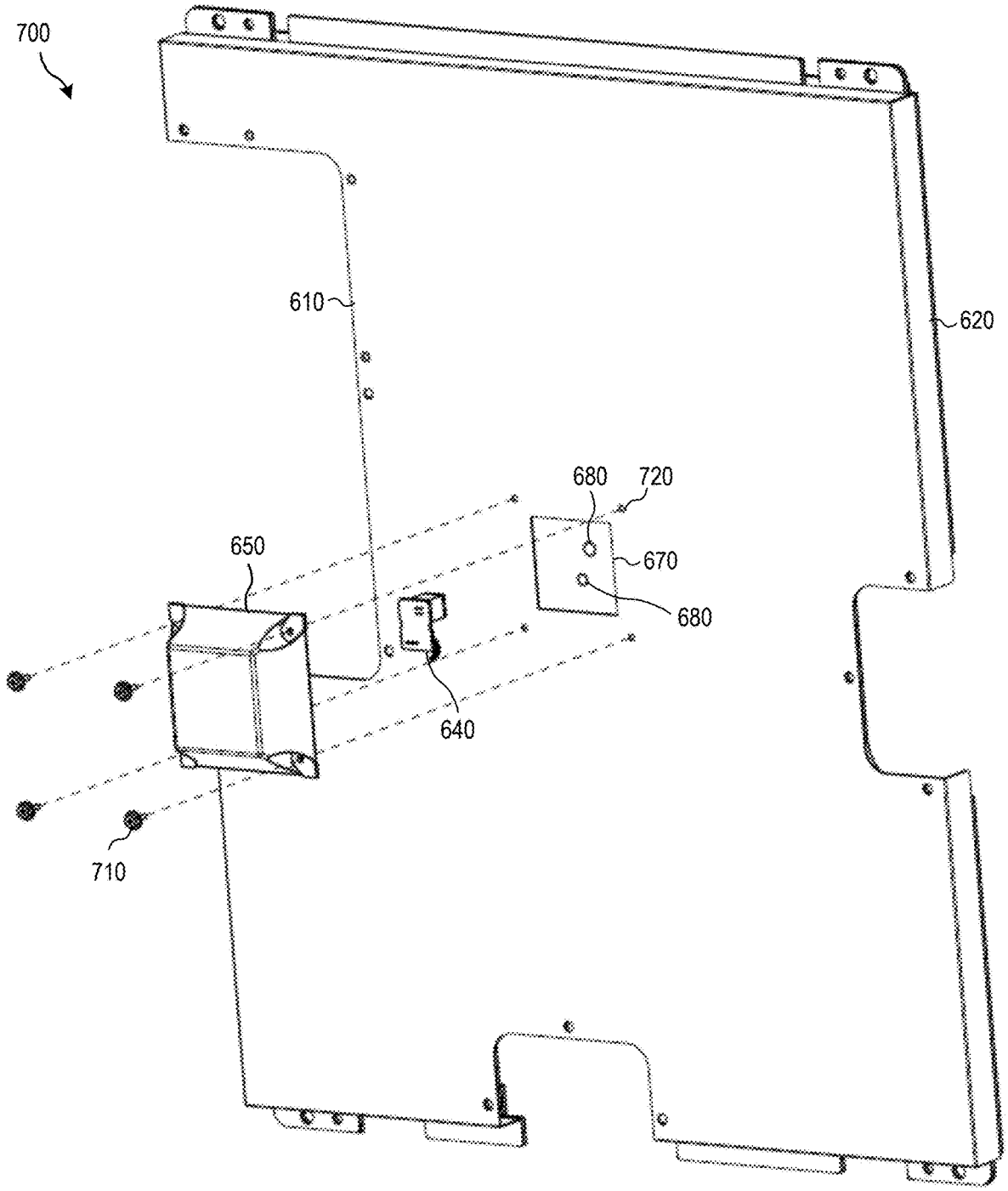
FIG. 7 is an expanded perspective view of the refrigerant sensor, the sensor cover, and the access panel of FIG. 6 according to disclosed embodiments.

FIG. 7 is an expanded perspective view of the refrigerant sensor 640, the sensor cover 650, and the access panel 610 of FIG. 6 according to disclosed embodiments.

As shown in FIG. 7, the sensor cover 650 is secured to the access panel 610 through the use of screws 710 that affix the sensor cover 650 to screw holes 720 in the access panel 610. In this way, the sensor cover 650 is secured to the access panel 610 in a manner such that the sensor cover 650 completely covers the refrigerant sensor 640 and the one or more holes 680.

Although screws 710 are used to affix the sensor cover 650 to the access panel 610 in the embodiment of FIGS. 6-9, this is by way of example only. Alternate embodiments could use a different means of securing the sensor cover 650 to the access panel 610. For example, alternate embodiments could employ holes, clamps, clips, magnets, adhesives, or any other desirable means of affixing the sensor cover 650 to the access panel 610

The refrigerant sensor 640 is placed in the opening 670 such that it is completely obscured by the sensor cover 650 and cover insulation 660.

As shown in FIG. 7, when the sensor cover 650 is removed, and the cover insulation 660 along with it, the refrigerant sensor 640 can be exposed without the need for removing the entire access panel 610. In this way, an operator or maintenance technician can access the refrigerant sensor 640 more easily and without having to remove the entire access panel 610. This can allow for easier monitoring, maintenance, repair, or replacement of the refrigerant sensor 640 as necessary.

Figure 8:
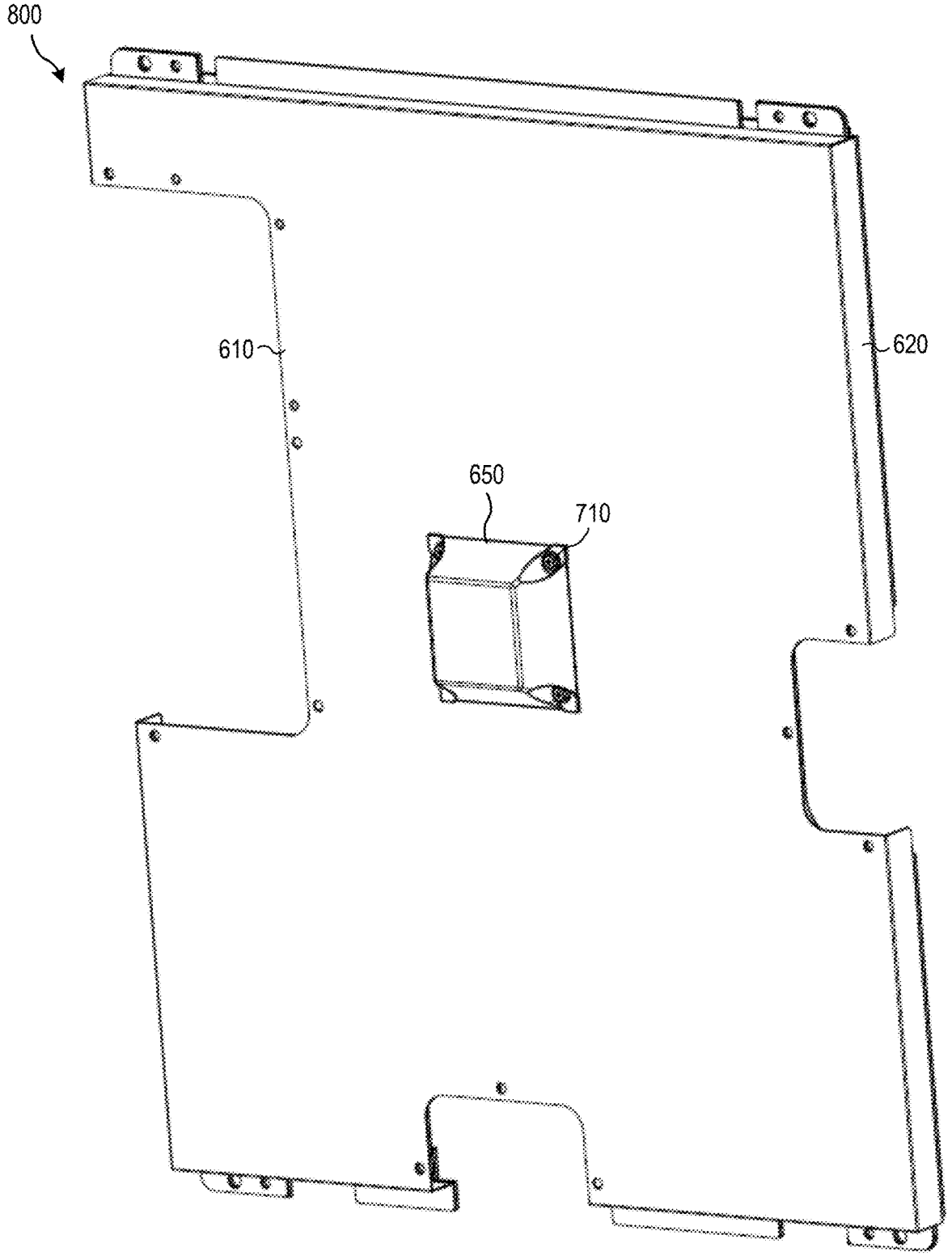
FIG. 8 is a perspective view of the refrigerant sensor, the sensor cover, and the access panel of FIG. 6 in a secured position according to disclosed embodiments.

FIG. 8 is a perspective view of the sensor cover 650, and the access panel 610 of FIG. 6 in a secured position according to disclosed embodiments.

As shown in FIG. 8, once the sensor cover 650 is secured to the access panel 610, the cover insulation 660, the refrigerant sensor 640, and the one or more holes 680 are completely obscured by the sensor cover 650. In this way, the refrigerant sensor 640 is protected by the sensor cover 650.

Figure 9:
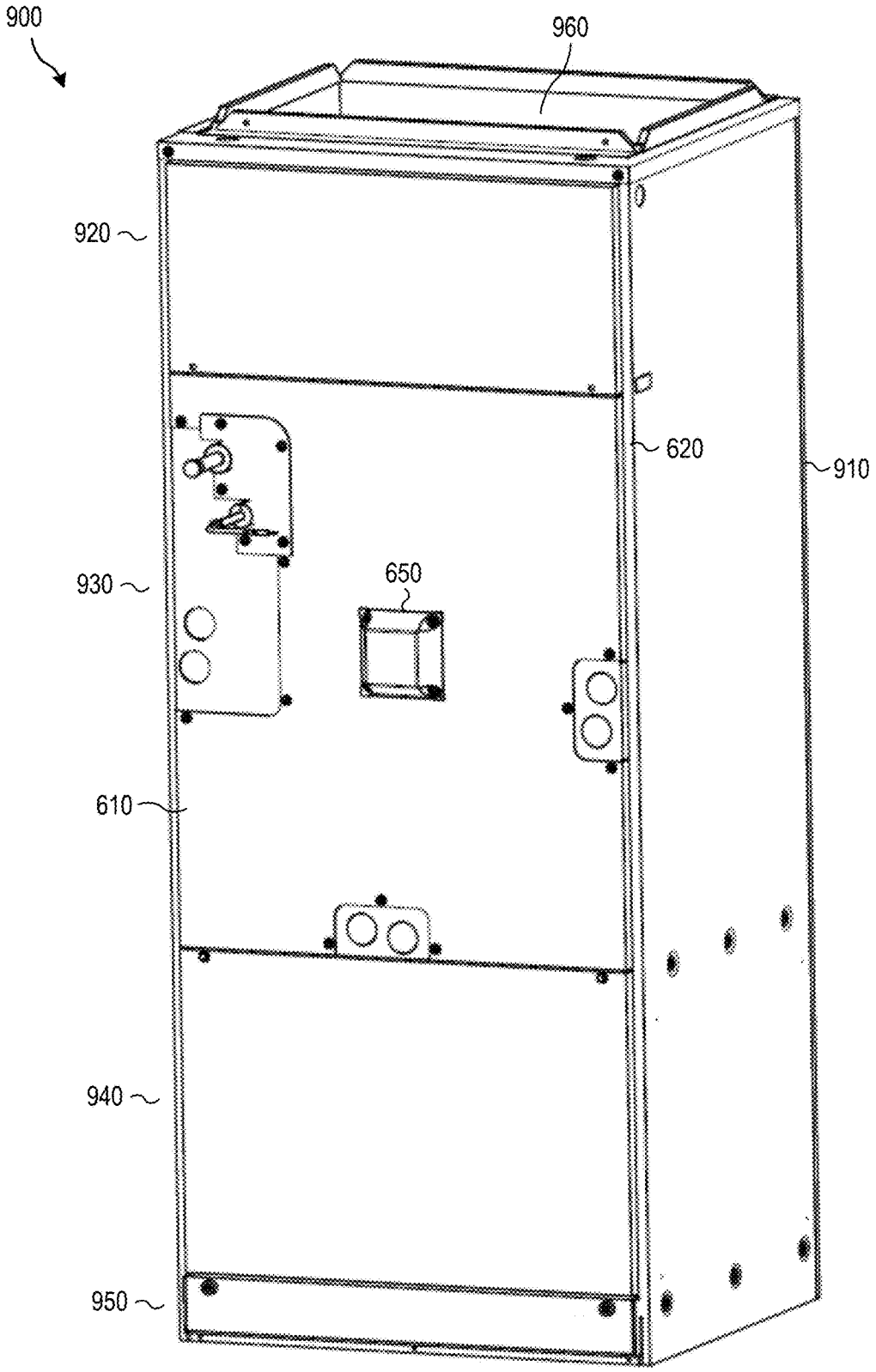
FIG. 9 is a perspective view of an air conditioner containing the refrigerant sensor, the sensor cover, and the access panel of FIG. 6 according to disclosed embodiments.

FIG. 9 is a perspective view of an air conditioner containing the refrigerant sensor 640, the sensor cover 650, and the access panel 610 of FIG. 6 according to disclosed embodiments FIG. 9 is a perspective view of an air conditioner 900 containing the refrigerant sensor 640 and access panel 610 of FIG. 6 according to disclosed embodiments.

As shown in FIG. 9, the air conditioner 900 includes an air-conditioner housing 910 that surrounds a number of elements that make up the air conditioner 900. These elements include an electrical section 920, a heat exchanger section 930, a blower section 940, and a filter section 950. In addition, a blow-out vent 960 is provided on the top of the air-conditioner housing 910.

The air-conditioner housing 910 (sometimes called simply the "housing") can be made of metal, plastic, or any suitable material that can protect the various elements that make up the air conditioner 900. The air-conditioner housing 910 substantially surrounds the elements that make up the air conditioner 900 with the exception of an opening (not shown) covered by the access panel 610, the blow-out vent 960, and an input vent (not shown) used to draw air into the air conditioner 900. The housing 910 may also have various other holes or openings to allow pipes, wires, and the like to pass between the interior of the housing 910 and the exterior of the housing 910.

The material that makes up the air-conditioner housing 910 can be metal, plastic, or any desirable material. This material may be the same material that makes up the access panel 610 in some embodiments, or it may be a different material than the material that makes up the access panel 610 in alternate embodiments.

The electrical section 920 includes some or all of the control electronics (not shown) required to operate the air conditioner 900.

The heat exchanger section 930 includes a heat exchanger (not shown) used to circulate refrigerant that exchanges heat with air passing through the air conditioner 900.

The blower section 940 includes a fan (not shown) used to draw air into the air conditioner 900, pass the air over the heat exchanger to exchange heat with the refrigerant, and expel the air from the blow-out vent 960.

The filter section 950 includes a filter (not shown) used to filter contaminants or other particulate matter out of the air passing through the air conditioner 900.

The blow-out vent 960 is an opening in the air-conditioner housing 910 that allows conditioned air to be expelled to an area outside of the air conditioner 900.

In the embodiment of FIG. 9, the electrical section 920, the heat exchanger section 930, the blower section 940, and the filter section 950 are stacked in that quarter from top to bottom. However, this is by way of example only. In alternate embodiments, the electrical section 920, the heat exchanger section 930, the blower section 940, and the filter section 950 can be rearranged in any desirable arrangement. For example, the heat exchanger section 930 could be in the middle of the air conditioner 900, on the top of the air conditioner 900, or on the bottom of the air conditioner 900, as desired.

The access panel 610 is arranged adjacent to the heat exchanger section 930 such that the heat exchanger section 930 can be exposed when the access panel 610 is removed. This allows for easier maintenance of the heat exchanger, or replacement of elements within the heat exchanger.

Furthermore, since the heat exchanger section 930 is the section of the air conditioner 900 most likely to suffer a refrigerant leak, the arrangement of the access panel 610 adjacent to the heat exchanger section 930 allows for the refrigerant sensor 640, and the sensor cover 650 to be arranged proximate to the heat exchanger for more efficient detection of a refrigerant leak.

This is particularly important given that some regulations require that refrigerant leaks be detected within a set minimum amount of time. By placing the refrigerant sensor 640 proximate to the heat exchanger, the refrigerant sensor 640 can be arranged in a position in which it is capable of sensing and a refrigerant leak within the prescribed time.

Alternate Embodiments

Figure 10:
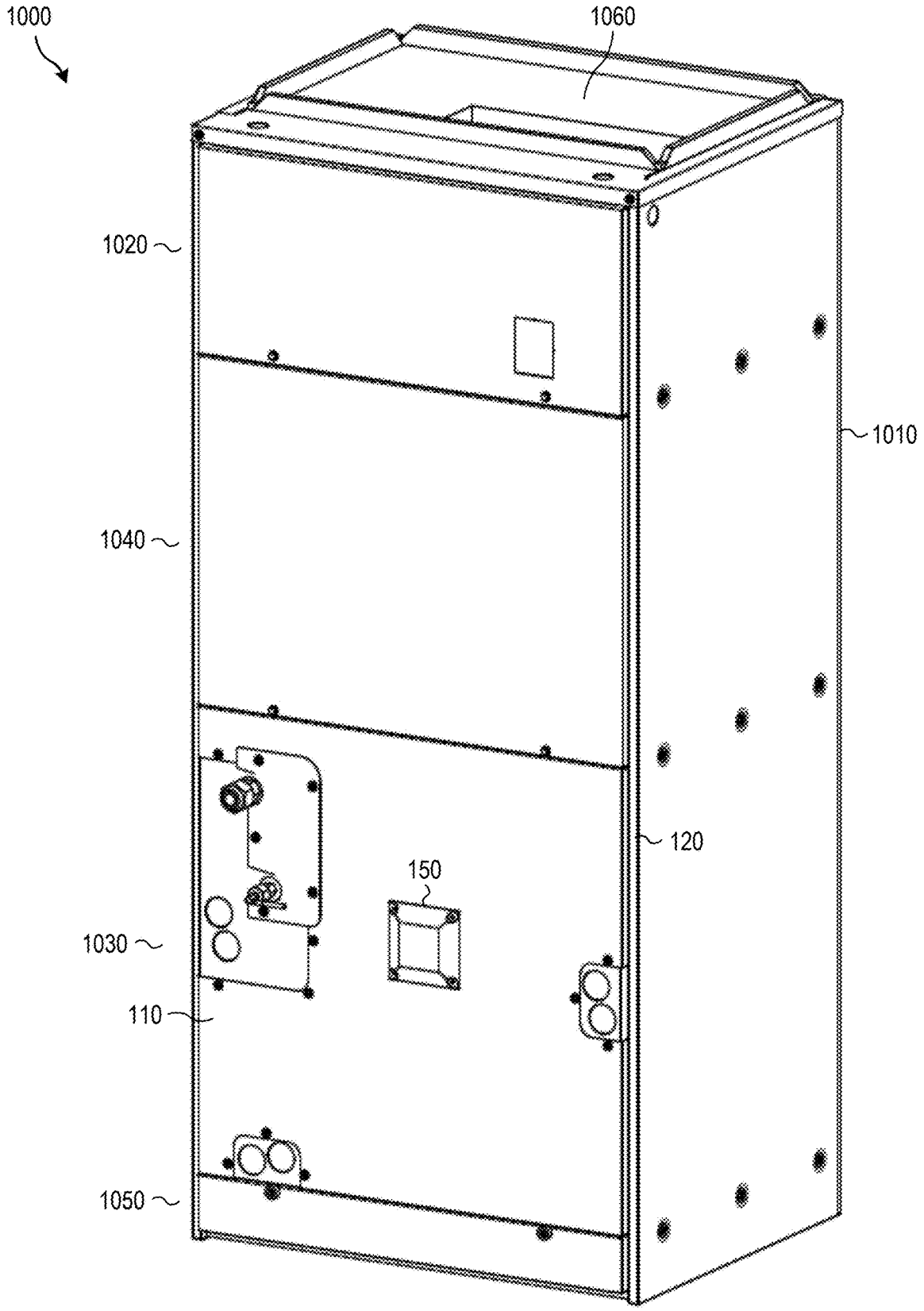
FIG. 10 is a perspective view of an air conditioner containing a refrigerant sensor, sensor cover, and an access panel according to alternate disclosed embodiments.

FIG. 10 is a perspective view of an air conditioner 1000 containing a refrigerant sensor (not shown), a sensor cover 150, and an access panel 110 according to alternate disclosed embodiments.

As shown in FIG. 10, the air conditioner 1000 includes an air-conditioner housing 1010 that surrounds a number of elements that make up the air conditioner 1000. These elements include an electrical section 1020, a heat exchanger section 1030, a blower section 1040, and a filter section 1050. In addition, a blow-out vent 1060 is provided on the top of the air-conditioner housing 1010.

The air-conditioner housing 1010 (sometimes called simply the "housing") can be made of metal, plastic, or any suitable material that can protect the various elements that make up the air conditioner 1000. The air-conditioner housing 1010 substantially surrounds the elements that make up the air conditioner 1000 with the exception of an opening (not shown) covered by the access panel 110, the blow-out vent 1060, and an input vent (not shown) used to draw air into the air conditioner 1000. The housing 1010 may also have various other holes or openings to allow pipes, wires, and the like to pass between the interior of the housing 1010 and the exterior of the housing 1010.

The material that makes up the air-conditioner housing 1010 can be metal, plastic, or any desirable material. This material may be the same material that makes up the access panel 110 in some embodiments, or it may be a different material than the material that makes up the access panel 110 in alternate embodiments.

The electrical section 1020 is comparable to the electrical section 420 in FIG. 4 and includes some or all of the control electronics (not shown) required to operate the air conditioner 1000.

The heat exchanger section 1030 is comparable to the heat exchanger section 430 in FIG. 4 and includes a heat exchanger (not shown) used to circulate refrigerant that exchanges heat with air passing through the air conditioner 1000.

The blower section 1040 is comparable to the blower section 440 in FIG. 4 and includes a fan (not shown) used to draw air into the air conditioner 1000, pass the air over the heat exchanger to exchange heat with the refrigerant, and expel the air from the blow-out vent 1060.

The filter section 1050 is comparable to the filter section 450 in FIG. 4 and includes a filter (not shown) used to filter contaminants or other particulate matter out of the air passing through the air conditioner 1000.

The blow-out vent 1060 is comparable to the blow-out vent 460 in FIG. 4 and is an opening in the air-conditioner housing 1010 that allows conditioned air to be expelled to an area outside of the air conditioner 1000.

In the embodiment of FIG. 10, the electrical section 1020, the blower section 440, the heat exchanger section 430, and the filter section 450 are stacked in that order from top to bottom. This contrasts with the embodiment of FIG. 4 in which the heat exchanger section 430 is located above the blower section 440. Again, this is by way of example only. In alternate embodiments, the electrical section 1020, the heat exchanger section 1030, the blower section 1040, and the filter section 1050 can be rearranged in any desirable arrangement.

Figure 11:
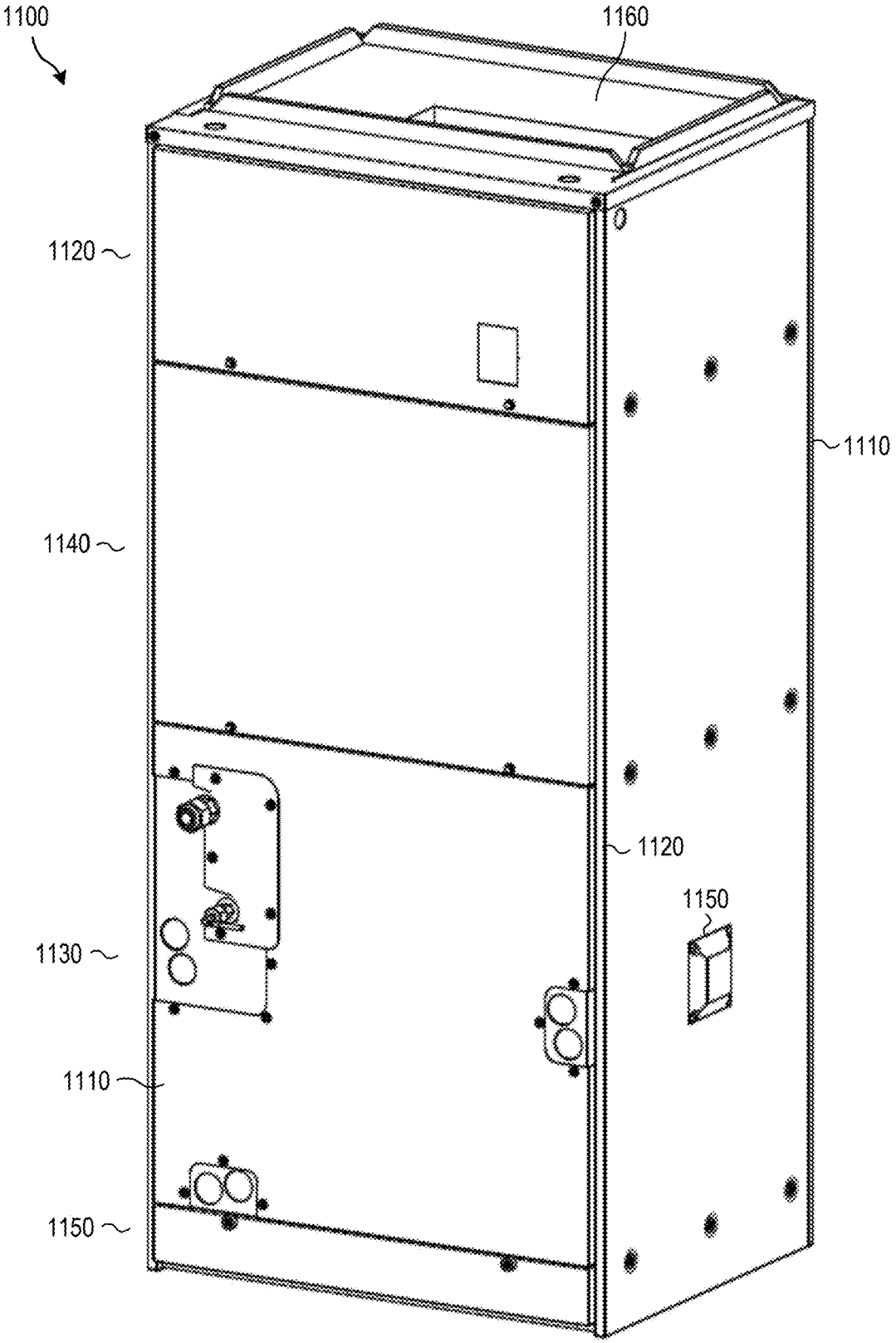
FIG. 11 is a perspective view of an air conditioner containing a refrigerant sensor, sensor cover, and an access panel according to further alternate disclosed embodiments.

FIG. 11 is a perspective view of an air conditioner containing a refrigerant sensor (not shown), a sensor cover 1150, and an access panel 1110 according to further alternate disclosed embodiments.

As shown in FIG. 11, the air conditioner 1100 includes an air-conditioner housing 1110 that surrounds a number of elements that make up the air conditioner 1100. These elements include an electrical section 1120, a heat exchanger section 1130, a blower section 1140, and a filter section 1150. In addition, a blow-out vent 1160 is provided on the top of the air-conditioner housing 1010.

The air-conditioner housing 1110 (sometimes referred to as simply the "housing") can be made of metal, plastic, or any suitable material that can protect the various elements that make up the air conditioner 1100. The air-conditioner housing 1110 substantially surrounds the elements that make up the air conditioner 1100 with the exception of an opening (not shown) covered by the access panel 110, the blow-out vent 1160, and an input vent (not shown) used to draw air into the air conditioner 1100. The housing 1110 may also have various other holes or openings to allow pipes, wires, and the like to pass between the interior of the housing 1110 and the exterior of the housing 1110.

The material that makes up the air-conditioner housing 1110 can be metal, plastic, or any desirable material. This material may be the same material that makes up the access panel 1110 in some embodiments, or it may be a different material than the material that makes up the access panel 1110 in alternate embodiments.

The electrical section 1120 is comparable to the electrical section 420 in FIG. 4 and includes some or all of the control electronics (not shown) required to operate the air conditioner 1000.

The heat exchanger section 1130 is comparable to the heat exchanger section 430 in FIG. 4 and includes a heat exchanger (not shown) used to circulate refrigerant that exchanges heat with air passing through the air conditioner 1100.

The blower section 1140 is comparable to the blower section 440 in FIG. 4 and includes a fan (not shown) used to draw air into the air conditioner 1100, pass the air over the heat exchanger to exchange heat with the refrigerant, and expel the air from the blow-out vent 1160.

The filter section 1150 is comparable to the filter section 450 in FIG. 4 and includes a filter (not shown) used to filter contaminants or other particulate matter out of the air passing through the air conditioner 1100.

The blow-out vent 1160 is comparable to the blow-out vent 460 in FIG. 4 and is an opening in the air-conditioner housing 1110 that allows conditioned air to be expelled to an area outside of the air conditioner 1100.

In the embodiment of FIG. 11, the electrical section 1020, the blower section 1140, the heat exchanger section 1130, and the filter section 1150 are stacked in that order from top to bottom. However, this is by way of example only. In alternate embodiments, the electrical section 1120, the heat exchanger section 1130, the blower section 1140, and the filter section 1150 can be rearranged in any desirable arrangement.

In the embodiment of FIG. 11, the access panel 1100 is located on the front of the air conditioner 1100 and allows for access to the heat exchanger section 1130. However, the sensor cover 1150 and the elements covered by the sensor cover 1150 are not formed on the access panel 1100.

In contrast, the sensor cover 1150, along which the refrigerant sensor (not shown) and the cover insulation (not shown) are formed on a different side of the housing from the access panel, but still in the heat exchanger section 1130. Although not explicitly shown, a refrigerant sensor will be located underneath the sensor cover 1150 on the side of the housing 1100. The exact structure of the sensor cover 1150 and refrigerant sensor can vary according to different embodiment and could include any of the embodiments shown in FIGS. 1-10.

Although the sensor cover 1150 and refrigerant sensor are not attached to the access panel 1100 in this embodiment, they still allow for easier access to the refrigerant sensor via the sensor cover 1150. Provided the side of the housing 1100 that contains the sensor cover 1150 is accessible by an operator or maintenance technician, the refrigerant sensor can be accessed for examination, maintenance, repair, or replacement by simply removing the sensor cover 1150. Thus, there is no requirement that the sensor cover 1150 and related structure be formed on a access panel 1110.

In the embodiment of FIG. 11, the sensor cover 1150 is arranged adjacent to the heat exchanger section 1130. Since the heat exchanger section 1130 is the section of the air conditioner 1100 most likely to suffer a refrigerant leak, the arrangement of the sensor cover 1150 and related structure adjacent to the heat exchanger section 1130 allows for the refrigerant sensor to be arranged proximate to the heat exchanger for more efficient detection of a refrigerant leak.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

The invention claimed is:

1. A housing for an air conditioner circuit, comprising:
an access panel configured to partially cover the air conditioner circuit and including
a panel surface formed on an outside of the housing,
a panel opening in the panel surface passing from the outside of the housing toward an inside of the housing;
a refrigerant sensor configured to detect a presence of a refrigerant in air proximate to the refrigerant sensor; and
a sensor cover attached to an outside of the housing and configured to cover the panel opening and the refrigerant sensor,
wherein
the refrigerant sensor is located at least partly inside the panel opening.

2. The housing of claim 1, wherein
the access panel further includes panel insulation attached to the panel surface and located between the panel surface and the air conditioner circuit,
the access panel further includes an insulation opening in the panel insulation passing from the outside of the housing toward the inside of the housing and formed contiguous with the panel opening, and
the refrigerant sensor is located at least partly inside the insulation opening.

3. The housing of claim 2, wherein
the refrigerant sensor is deeper than a panel depth of the panel surface and an insulation depth of the panel insulation combined.

4. The housing of claim 1, wherein the sensor cover includes:
a sensor cover surface; and
sensor insulation formed between the sensor cover surface and the panel opening.

5. The housing of claim 1, wherein the sensor cover is formed in the shape of a truncated pyramid.

6. The housing of claim 1, wherein the refrigerant sensor further comprises:
a sensor circuit configured to detect a presence of the refrigerant in air proximate to the sensor circuit; and
a sensor casing surrounding the sensor circuit.

7. The housing of claim 1, wherein the access panel is located on a side of the air conditioner circuit facing where pipes in a heat exchanger in the air conditioner circuit have been brazed.

8. The housing of claim 1, further comprising:
a mounting bracket attached to the panel surface and extending into or adjacent to the panel opening,
wherein
the refrigerant sensor is affixed to the mounting bracket.

9. A housing for an air conditioner circuit, comprising:
a housing surface formed on an outside of the housing;
a housing opening in the housing surface passing from the outside of the housing toward an inside of the housing;
a refrigerant sensor configured to detect a presence of a refrigerant in air proximate to the refrigerant sensor; and
a sensor cover affixed to an outside of the housing and configured to cover the housing opening and the refrigerant sensor,
wherein
the refrigerant sensor is located at least partly inside the housing opening.

10. The housing of claim 9, wherein
the housing further includes housing insulation attached to the housing surface and located between the housing surface and the air conditioner circuit,
the housing further includes an insulation opening in the housing insulation passing from the outside of the housing toward the inside of the housing and formed contiguous with the housing opening, and
the refrigerant sensor is located at least partly inside the insulation opening.

11. The housing of claim 10, wherein
the refrigerant sensor is deeper than a housing depth of the housing surface and an insulation depth of the housing insulation combined.

12. The housing of claim 9, wherein the sensor cover includes:
a sensor cover surface; and
sensor insulation formed between the sensor cover surface and the housing opening.

13. The housing of claim 9, wherein the refrigerant sensor further comprises:
a sensor circuit configured to detect a presence of the refrigerant in air proximate to the sensor circuit; and
a sensor casing surrounding the sensor circuit.

14. The housing of claim 9, wherein the housing opening is located on a side of the air conditioner circuit facing where pipes in a heat exchanger in the air conditioner circuit have been brazed.

15. The housing of claim 9, further comprising:
a mounting bracket attached to the housing surface and extending into or adjacent to the housing opening,
wherein
the refrigerant sensor is affixed to the mounting bracket.

16. A housing for an air conditioner circuit, comprising:
an access panel configured to partially cover the air conditioner circuit and including
a panel surface formed on an outside of the housing,
a panel hole in the panel surface passing from the outside of the housing toward an inside of the housing;
a refrigerant sensor configured to detect a presence of a refrigerant in air proximate to the refrigerant sensor; and a sensor cover affixed to an outside of the housing and configured to cover the panel hole and the refrigerant sensor, wherein the refrigerant sensor is located at least partly between the sensor cover and the access panel.

17. The housing of claim 16, wherein the refrigerant sensor is located entirely between the sensor cover and the access panel.

18. The housing of claim 16, further comprising one or more connection wires connected between the refrigerant sensor and the air conditioner circuitry, wherein the one or more connection wires pass through the panel hole.

19. The housing of claim 16, wherein the sensor cover includes:

a sensor cover surface; and sensor insulation formed between the sensor cover surface and the access panel, and the refrigerant sensor is located at least partly between the sensor insulation and the access panel.

20. The housing of claim 19, wherein the refrigerant sensor is located entirely between the sensor insulation and the access panel.

* * * * *